US005476156A

United States Patent [19]

Gerber

[11] Patent Number: 5,476,156

[45] Date of Patent: Dec. 19, 1995

[54] RAIL ASSEMBLY FOR A STATIONARY INCLINED ELEVATOR

[75] Inventor: Hans Gerber, Surrey, Canada

[73] Assignee: Garaventa Holding AG, Goldau, Switzerland

[21] Appl. No.: 263,725

[22] Filed: Jun. 22, 1994

[30] Foreign Application Priority Data

Jul. 2, 1993 [CH] Switzerland ..... 02014/93

[51] Int. Cl.[6] ..... B66B 7/02; B66B 9/06; B61B 5/02

[52] U.S. Cl. ..... 187/245; 187/201; 187/239

[58] Field of Search ..... 187/245, 201, 187/239

[56] References Cited

FOREIGN PATENT DOCUMENTS

| | | | |
|---|---|---|---|
| 291739 | 11/1988 | European Pat. Off. | 187/245 |
| 3717662 | 12/1988 | Germany | 187/239 |
| 615789 | 1/1949 | United Kingdom . | |

OTHER PUBLICATIONS

Patent Abstracts of Japan, vol. 14, No. 517 (Nov. 1990).

*Primary Examiner*—William E. Terrell
*Assistant Examiner*—Luong Nguyen
*Attorney, Agent, or Firm*—Sughrue, Mion, Zinn, Macpeak & Seas

[57] ABSTRACT

A substantially straight rail assembly on which a carriage of a stationary inclined elevator is guided includes two track rails, each having two legs joined by a web having a plurality of holes. Box-shaped frames, each comprising two rails having holes and coupled together with transverse bars, are screwed to the track rails at arbitrary positions in the longitudinal direction of the track rails to couple the track rails together at a predetermined distance from each other. Splice frames connect additional pairs of track rails to the track rails. The box-shaped frames and splice frames are removably mounted to foundations positioned along a gradient surface to mount the rail assembly to the gradient surface at desired angles of inclination. A cable winch or revolving cable drive moves a carriage of the inclined elevator along the track rails.

14 Claims, 4 Drawing Sheets

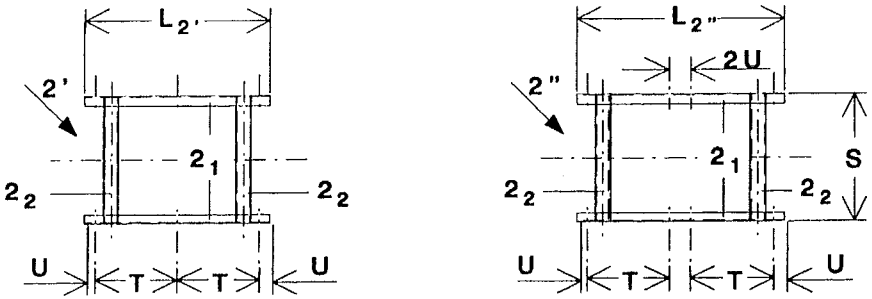
FIG. 2a
FIG. 2b
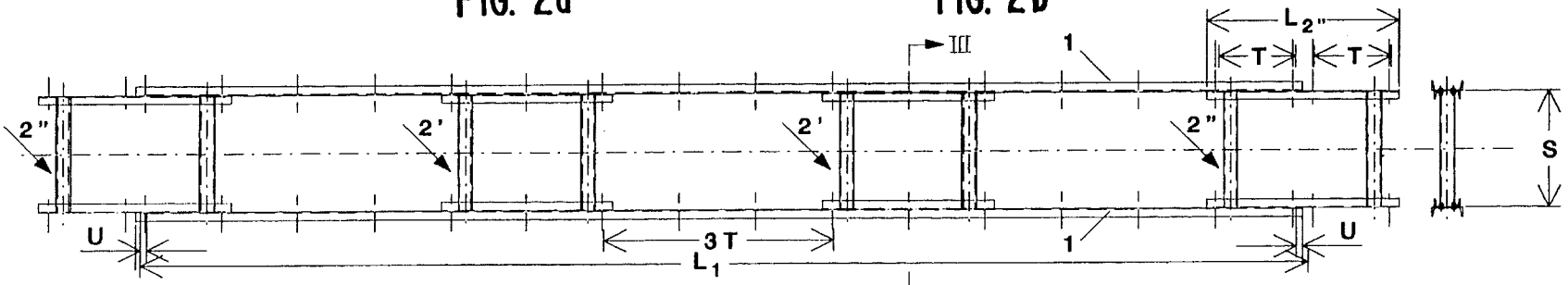
FIG. 2c
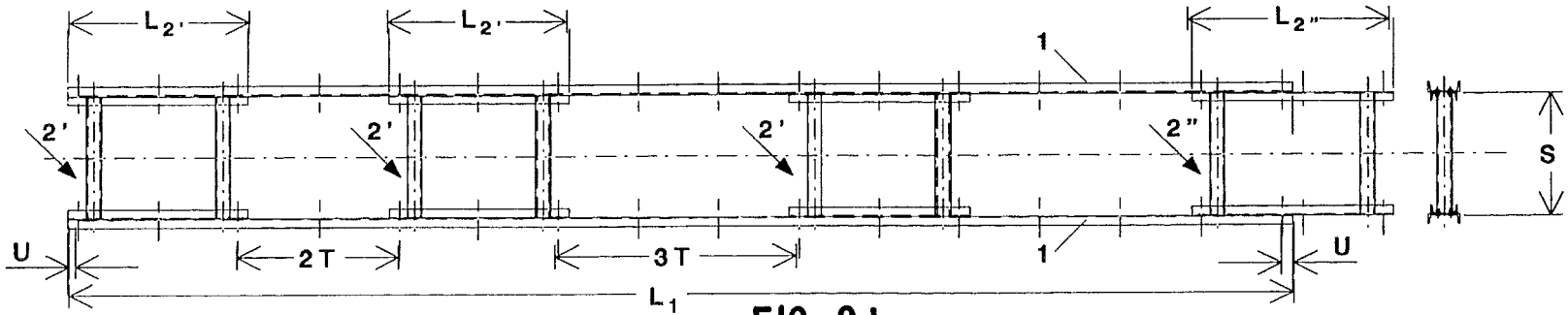
FIG. 2d

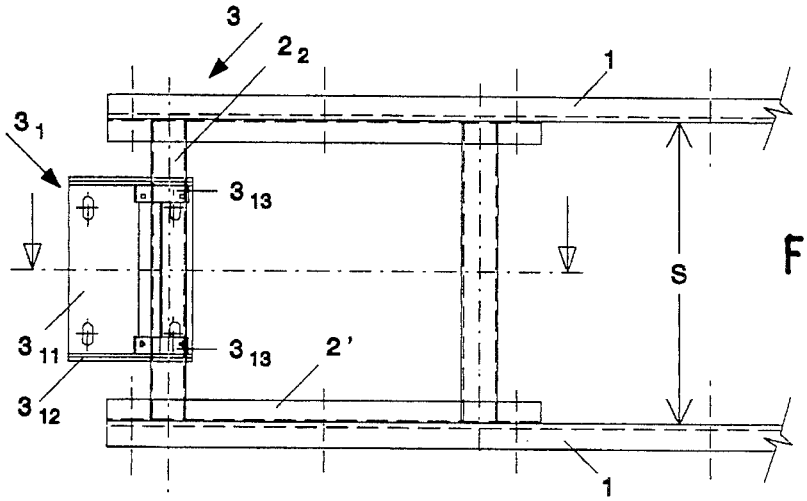
FIG. 5a
FIG. 5b
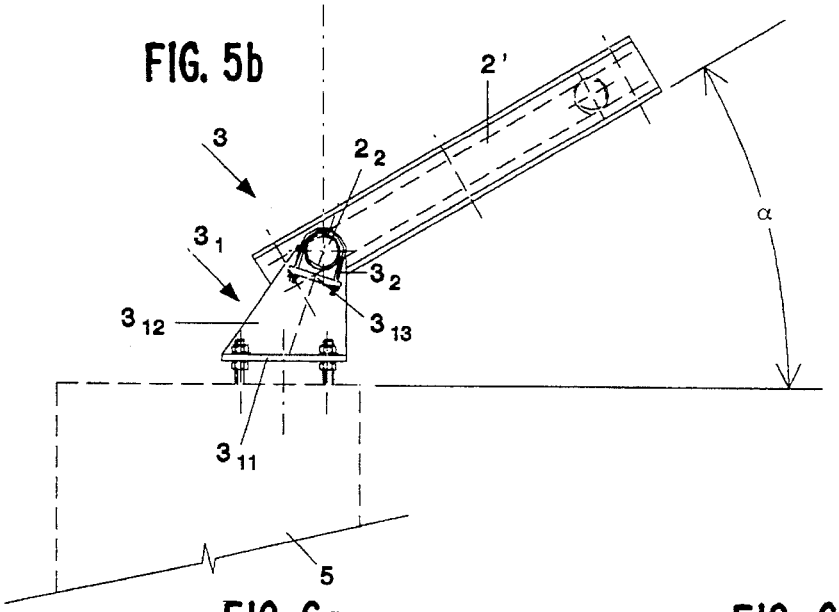
FIG. 6a
FIG. 6b
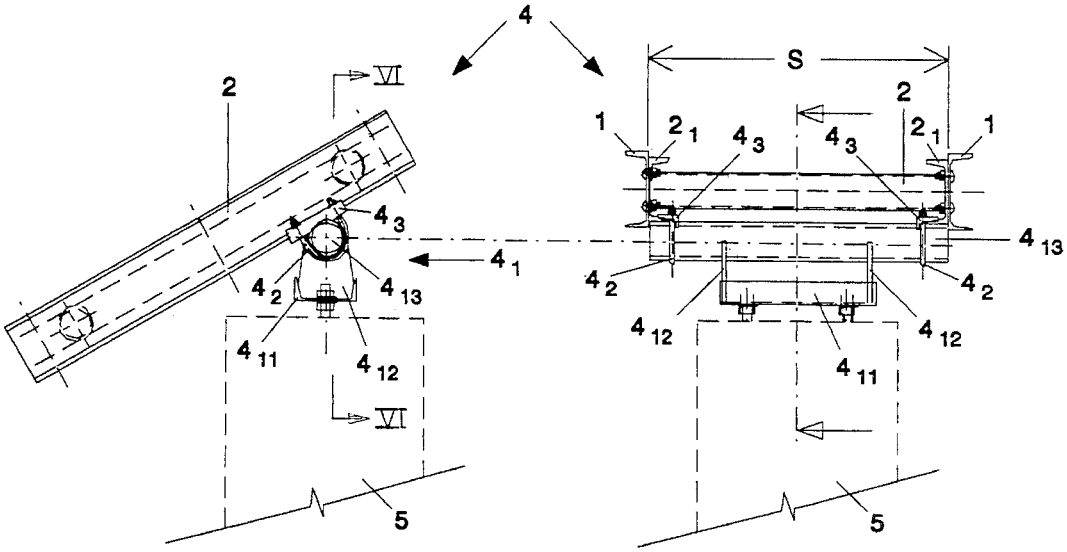

RAIL ASSEMBLY FOR A STATIONARY INCLINED ELEVATOR

BACKGROUND OF THE INVENTION

1. Field of the Invention

The invention relates to a rail assembly, typically a straight or substantially straight rail assembly, upon which a carriage of a stationary inclined elevator is guided.

2. Description of the Related Art

Stationary inclined elevators are used to convey both people and loads, and are positioned at angles of inclination corresponding to an angle of the gradient on which the elevator rails are mounted. For example, a precipitous terrain on which it is difficult to walk can be bridged with an inclined elevator.

An inclined elevator can also serve as an alternative for stairs. For example, an inclined elevator can be installed from a boat house or garage to a dwelling above. They also can operate as a freight and passenger lift in a multi-floor house and in doing so, have the capability of stopping at any floor in the house. For industrial applications, an inclined elevator can be used as a lift, for example, to enable a person to access pipes positioned high above the floor in a warehouse or power plant, inspect the walls of dikes, or to move objects in underground tunnels and the like.

Stationary inclined elevators are especially important for conveying handicapped people, such as those confined to a wheelchair, who cannot climb stairs without assistance. Further, inclined elevators can be retrofit in train stations or other public buildings of any kind which were not originally built with such elevators, because the elevators can be constructed directly at the edge of the stairs in the building.

Many diverse models of straight or substantially straight rail assemblies for stationary inclined elevators exist. Such rail assemblies are predominantly metal assemblies whose pieces are welded together as they are mounted to the inclined surface in accordance with desired specifications. Therefore, it is quite expensive to erect inclined elevators typically known in the art. However, alternative designs exist, in which individual elements of the rail assembly are screwed together during assembly (see, for example, the U.S. Journal: Elevator World, August 1986, pp. 44 to 52, in particular, the figures on page 46).

A straight or substantially straight rail assembly for a mobile inclined elevator (e.g., for construction purposes), whose rails can be assembled from several pairs of angle sections of fixed length, is described in British Patent Application GB615789 (see, in particular, FIGS. 1 and 8–11). In this design, the angle sections are rigidly connected together (apparently welded), like the rungs of a ladder, by tubes. Successive pairs of rails are joined together detachably (apparently screwed) with spliced frames, in order to adapt the length of the rail assembly to the special features of the construction site. The splice frames consist of two plates, which are rigidly joined together to the frame by two tubes. Other frames are not provided, and no supports engage the frame.

SUMMARY OF THE INVENTION

An object of the present invention is to provide, for stationary inclined elevators, an easy to assemble rigid and torsion-proof rail assembly which is constructed of modules and whose elements can be adapted extensively to all possible surface gradients. Preferably, little or no welding is required to assemble and mount such a rail assembly. Accordingly, the rail assembly of the present invention provides an inexpensive alternative as compared to known rail assemblies for stationary inclined elevators.

A rail assembly according to an embodiment of the present invention comprises two first rails, arranged symmetrically and parallel or substantially parallel at a predetermined distance from each other. Each of the first rails each have two leg portions joined by a web. The two leg portions of one of the first rails face away from the two leg portions of the other first rail, and the web of each rail has a plurality of holes drilled therein which are spaced uniformly along the longitudinal direction of the rail.

That embodiment of the present invention further comprises a plurality of box-shaped frames, which set the distance between the two rails (i.e track gauge). The frames are detachably mounted between the two first rails at any arbitrary point along the two rails, and each comprise two second rails, which are arranged symmetrically and parallel or substantially parallel to each other. The two second rails each comprise two legs which are joined by a web. The two legs of one of the second rails face the two legs of the other second rail.

The web of each of the second rails have two rows of three boreholes drilled therein which are spaced at identical distances from each other along the longitudinal direction of the second rail. Further, the web of each second rail rests against the web of a corresponding first rail, and the second rails are rigidly coupled together by at least two transverse bars. Preferably, the two transverse bars are tubes which are welded to the second rails to secure the second rails together.

Foundations, which are made of steel-reinforced concrete, steel constructions, or the like, are positioned on the surface gradient to which the rail assembly is adapted. In order to secure the rail assembly to the foundations, bearing supports, which each consist in essence of a single welded bracket, are removably mounted to the foundations.

The embodiment of the present invention comprises a fixed bearing support and at least one floating bearing support, both of which are removably mounted, along a predetermined line of inclination, to corresponding foundations. One of the frames is removably rotatably engaged with the fixed bearing support by, for example, a U-bolt.

Preferably, the fixed bearing support is mounted to the foundation at the very bottom of the gradient surface. However, if the nature of the gradient surface does not permit this (e.g. the gradient surface is soft subsoil), the fixed bearing support can be mounted to any other foundation.

The other frames are removably pivotably mounted to corresponding floating bearing supports, which can vary in number. The floating bearing supports allow small longitudinal displacements of the second rails mounted thereto and thus permit small longitudinal displacements of the entire rail assembly due to, for example, thermal expansions, load stresses or the like.

The frames, along with the brackets of the fixed bearing support and floating bearing supports can be prefabricated in a factory and connected detachably to the appropriate components of the rail assembly during assembly of the rail assembly. Hence, no welding needs to be done at the construction site to install the rail assembly. Rather, all detachable connections are preferably screwed connections.

In another embodiment of the present invention, the second rails of the frames are smaller by one standard dimension than the first rails. Hence, when the webs of corresponding first and second rails are mounted together by screws or the like, steps between the upper and the bottom edges of the legs of the corresponding first and second rails are formed. Thus, at each floating bearing support, a transverse bar of the bracket of that support protrudes into this step and therefore provides additional rigidity to the rail assembly as well as a lateral guide for the rail assembly.

The rigidity of the rail assembly can be further increased if the boreholes having identical spacing are arranged in two parallel rows in the longitudinal direction in the webs of the first rails and in the second rails of the frames.

The above embodiments can be used to provide various length rail assemblies.

For example, a rail assembly for a short inclined elevator comprises a single pair of first rails, and has two foundations for mounting a fixed bearing support and a floating bearing support. Such a rail assembly requires only central frames for assembly.

For an inclined elevator of medium length, that is, up to about 40 meters long, several pairs of first rails are coupled together. Each first rail has a specific fixed length, preferably about 6 meters.

To couple the rails, splice frames are provided that compensate for a projecting portion having a projecting length at the ends of the first rails. The rails of the splice frames preferably have four boreholes therein. Preferably, the two central boreholes are offset by twice the projecting length in the longitudinal direction, and the two end pairs of boreholes are spaced like those boreholes of the central frames. Thus, the splice frames are longer than the central frames by twice the projecting length.

The span length, at which the foundations are positioned on the gradient surface, is preferably adapted to be less than the fixed length of the first rails, so that each pair of first rails is mounted to a corresponding foundation. If it is necessary to position two successive foundations an excessive length apart, because, for example, a wide ditch has to be bridged over a pathless terrain, then more frames can be placed closer together between the rails, if necessary, to impart additional rigidity to the rail assembly.

The short and medium length inclined elevators described above further include a winch assembly which comprises, for example, a commercially available double cable winch having a motor, speed transforming gear and brake. The winch assembly is provided in a separate frame and is screwed between the first rails.

Preferably, the cable winch is disposed above the uppermost foundation and thus is at the top of the rail system. However, the cable winch can also be disposed at any other arbitrary place between the rails. In this case, then the two traction ropes should pass around rollers at the upper transverse bar of the central frame closest to the top of the rail assembly.

According to the invention, long inclined elevators can be any arbitrarily length within logical limits. Such long inclined elevators are equipped with a revolving traction cable, which loops around a drive wheel at one end of the rail assembly, preferably at the top. A deflecting wheel is positioned at the other end of the rail assembly, wherein a typical tensioning device provides tensioning of the traction cable.

Inclined elevators having a revolving cable drive preferably have wider frames than the winch-driven inclined elevators and thus, have a correspondingly wider track gauge. Hence, the carriage can be wider and longer than the carriage used in the winch-driven inclined elevators.

Further, long inclined elevators having revolving cable drives are driven at higher driving speeds than winch-driven inclined elevators. Hence, it is desirable that the first rails be larger by one or two standard dimensions than the first rails in the winch-driven inclined elevators. The size of the second rails of the frames, however, can be the same in both the winch-driven inclined elevators and the revolving cable drive elevators.

In addition, according to the present invention, the angle of inclination of the rail assembly can be adapted to an angle of gradient that changes periodically by, for example, using a pair of first rails having a large radial bend. The rails of the frames also can have radial bends. Further, the change in the angle of inclination can be positive or negative.

In addition, all inclined elevators of the present invention include the usual safety devices and have a controller which controls movement of the carriage along the rail assembly, thus allowing the carriage to stop at desired positions along the rail assembly.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which:

FIG. 2*a* illustrates an embodiment of a central frame of the present invention;

FIG. 2*b* illustrates an embodiment of a splice frame of the present invention;

FIG. 2*c* shows an embodiment of the rail assembly of the present invention having several central and splice frames;

FIG. 2*d* shows an embodiment of the rail assembly of the present invention having several central and splice frames;

FIG. 5*a* is an enlarged top view of the fixed bearing shown in FIG. 1*a;*

FIG. 5*b* is an enlarged side view of the fixed bearing shown in FIG. 1*a;*

FIG. 6*a* is an enlarged side view of one of the floating bearings shown in FIG. 1*a;* and FIG. 6*b* is a cross sectional view taken along lines VI—VI of FIG. 6*a* of one of the floating bearings mounted on a foundation.

DETAILED DESCRIPTION OF THE PREFERRED EMBODIMENTS

Figures 1A, 1B, 1C:
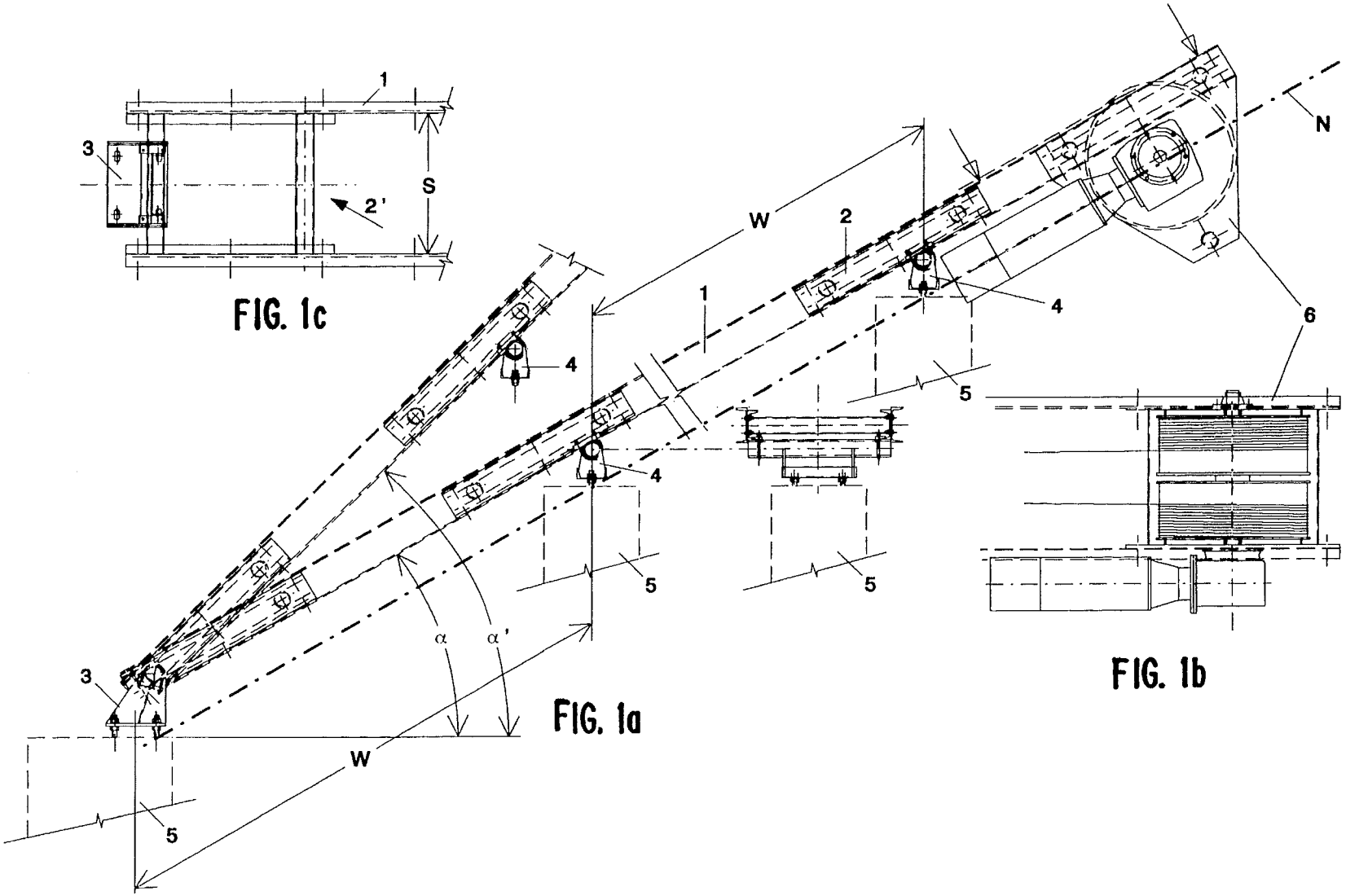
FIG. 1*a* illustrates an embodiment of the stationary inclined elevator and rail assembly according to the present invention.
FIG. 1*b* illustrates a cable winch assembly mounted to the rails of the inclined elevator.
FIG. 1*c* shows the spacing of the rails.

As shown in FIG. 1, a straight or substantially straight inclined elevator is erected having a rail 1 substantially parallel to a line of inclination N, which slopes linearly at an angle of inclination $\alpha$ on a sloping terrain (not shown). The angle of inclination α or α' of line N is adaptable over a wide range based on the slope of the terrain.

The foundations 5, on which the rail system of the inclined elevator is braced Supports 3 and 4, is positioned at regular intervals, if possible, along the gradient. The foundations 5 can be concrete, steel-reinforced concrete, steel constructions or the like.

A fixed bearing support 3 is mounted to the foundation 5 at the lowest position along the direction of inclination, while floating bearing supports 4 are mounted to the other foundations 5. A winch assembly 6, such as a commercially available double cable winch having a motor, speed transforming gear and brake, is mounted to or integral with the rails 1 at the top of the inclined elevator.

As shown in FIG. 1*b*, the cable winch assembly 6 is mounted between the rails 1 by screws, bolts or the like. The cable winch assembly 6 includes two cables which are secured to the carriage (not shown) of the elevator. Thus, the cable winch pulls and lowers the carriage along the rails 1.

The two rails 1 for the carriage extend linearly at a distance from each other which, as shown in FIG. 1*c*, is their fixed track gauge "S". Of course, the rails 1 can be spaced at any suitable distance from each other, thus establishing any track gage.

The details of the rail construction are shown in FIGS. 2*a–d* and 3.

As illustrated in FIGS. 2*c–d*, the two rails 1 are positioned parallel or substantially parallel to each other. As illustrated in the cross sectional view of FIG. 3, each rail 1 consist of two legs 11, which are connected via a web $\mathbf{1}_2$, thus forming a channel between the two legs $\mathbf{1}_1$. The two legs $\mathbf{1}_1$ of each rail 1 point outwardly in the lateral direction.

Each rail has the fixed length $L_1$, and its web $\mathbf{1}_2$ has two parallel rows of boreholes of equal spacing T along the longitudinal direction. The number and spacing of boreholes could vary as desired. A projecting length U, extending relative to a respective borehole, is present at the end of each rail 1.

Figure 3:
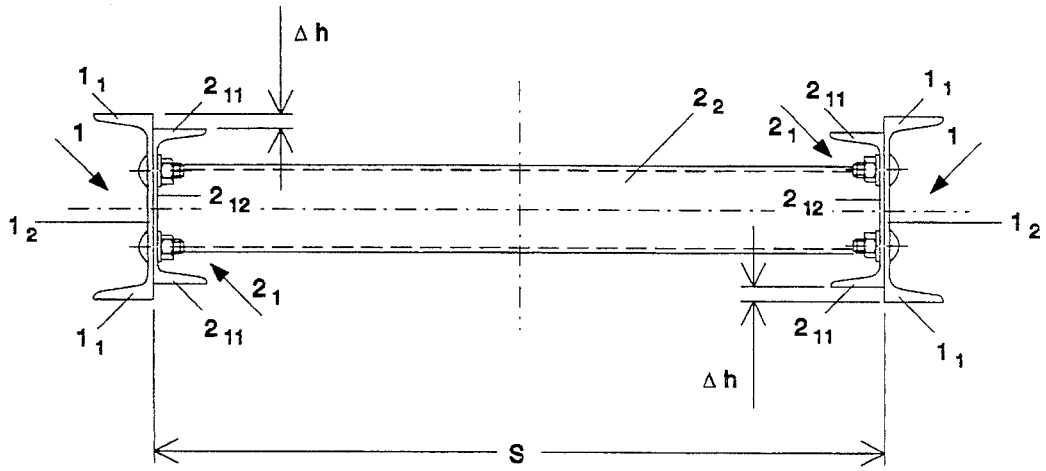
FIG. 3 is a cross sectional view of a frame mounted to the rails of the rail assembly taken along lines III—III in FIG. 2*c;*

Box-shaped frames 2' and 2" are mounted at regular intervals between the two first channels 1 with screws or the like. As shown in FIGS. 2*a* and 3, each frame 2' comprises two parallel, laterally reversed second rails $\mathbf{2}_1$, each having a short length $L_2$ and whose two legs $\mathbf{2}_{11}$ point inwardly. The height of the webs $\mathbf{2}_{12}$ of the second rails $\mathbf{2}_1$ is shorter by one standard dimension than the height of the webs $\mathbf{1}_1$ of the first channels 1. The webs $\mathbf{1}_2$ and $\mathbf{2}_{12}$ of both channels 1 or $\mathbf{2}_1$, respectively, are mounted together centrally by roundheaded screws or the like, so that a step Δh is formed between the upper and bottom edges of the legs $\mathbf{1}_1$ and $\mathbf{2}_{11}$ of the first 1 and second rails $\mathbf{2}_1$, respectively, as shown in FIG. 3.

Two tubes $\mathbf{2}_2$, defining the track gauge (e.g. "S") of the rails 1 are mounted symmetrically in the longitudinal direction between the two second rails $\mathbf{2}_1$ of the frame 2' and are secured to the two legs $\mathbf{2}_{11}$ of the second rails $\mathbf{2}_1\mathbf{1}$ by welding or the like to form the frame 2'. Alternatively, the tubes $\mathbf{2}_2$ could be mounted to the two legs $\mathbf{2}_{11}$ of the second rails $\mathbf{2}_1$ by screws, bolts or the like to form the frame 2'.

The embodiment of the present invention comprises two kinds of frames, in particular, a central frame 2' shown in FIG. 2*a*, and a splice frame 2" shown in FIG. 2*b*. As described above, according to FIG. 2*a*, the central frame 2' has two rails $\mathbf{2}_1$ each having a length $L_2'$. Each rail $\mathbf{2}_1$ has two rows of three boreholes identically spaced at a distance T along the longitudinal direction of the rail $\mathbf{2}_1$, and projecting ends having a length U at each end of the rail $\mathbf{2}_1$. The number and spacing of the boreholes could vary as desired.

As shown in FIGS. 2*c* and *d*, the central frames 2' are mounted in the central region of each pair of rails 1 and can be offset by two divisions 2T or three divisions 3T in the longitudinal direction along the rails 1. A central frame 2' is also placed, as shown on the left in FIG. 2*d*, at the bottom end of the rails 1. The fixed bearing 3 engages with this central frame 2' (see FIG. 1*a*).

As shown in FIG. 2*b*, the splice frame 2" includes two rails $\mathbf{2}_1$ each having two rows of four boreholes in the longitudinal direction, and projecting ends U at each end of the rails $\mathbf{2}_1$. The two central boreholes in each row are spaced at intervals 2U, and the two outer pairs of boreholes are spaced at a distance T apart from each other. As illustrated in FIGS. 2*c* and 2*d*, the splice frames 2" are mounted at the ends of a pair of rails 1 to which another pair of rails 1 is to be connected.

Figure 4:
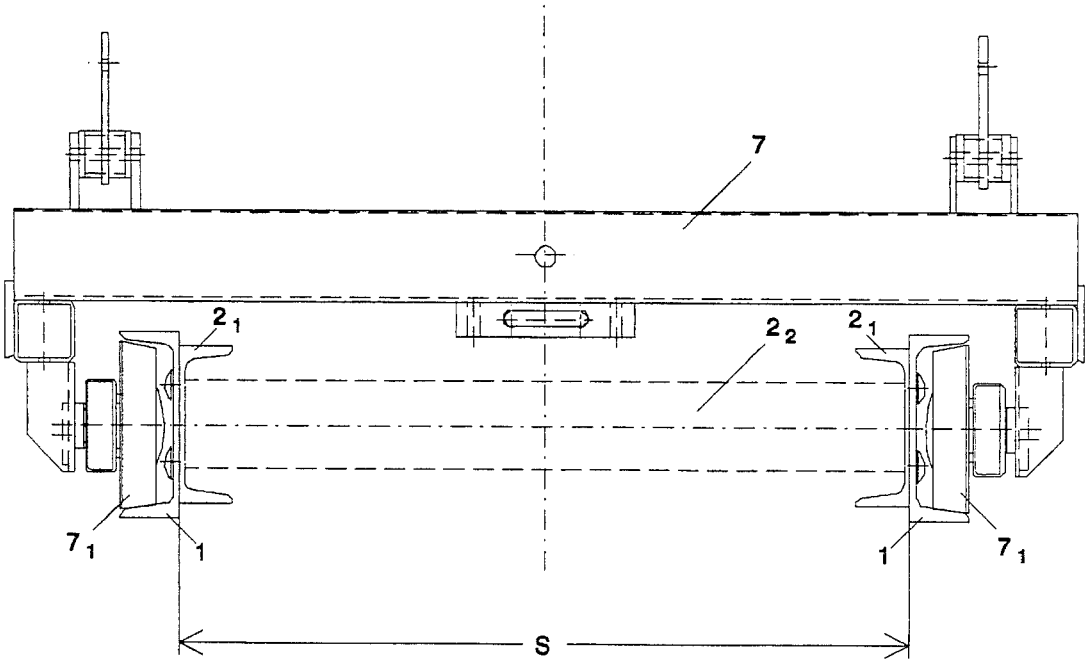
FIG. 4 is a cross sectional view showing wheels of the carriage engaging with the rails of the rail assembly.

FIG. 4 illustrates running wheels $\mathbf{7}_1$ of the carriage 7 engaged with the rails 1. The running treads of the wheels $\mathbf{7}_1$ are adapted to the slope of the inner legs $\mathbf{1}_1$ of the rails 1. The wheels $\mathbf{7}_1$ lockingly engage, with some play, the cavity between the legs $\mathbf{1}_1$ of the first rails 1, and roll along the bottom legs $\mathbf{1}_1$.

As described with regard to FIG. 1*a*, the rail construction shown in FIGS. 2*a–d* and 3 is mounted to the foundations 5 by supports 3 and 4.

FIGS. 5*a–b* illustrate the construction of the individual fixed bearing 3. The fixed bearing 3 comprises a one-piece bracket 31 having a base plate $\mathbf{3}_{11}$ with two parallel arms $\mathbf{3}_{12}$ attached rigidly to the ends of the base plate. Each arm $\mathbf{3}_{12}$ has a receptacle opening, for example, in the shape of a semi-circle at its top for receiving a tube $\mathbf{2}_2$ of one of the frames 2'. Each arm 312 also includes a cross piece $\mathbf{3}_{13}$ that is integral therewith or rigidly attached thereto. The base plate $\mathbf{3}_{11}$ and arms $\mathbf{3}_{12}$ with cross pieces $\mathbf{3}_{13}$ are arranged symmetrically with respect to one another and are mounted to the one-piece bracket $\mathbf{3}_1$ of the fixed bearing 3 by welding, screws, bolts or the like.

The bottommost pair of rails 1 in the direction of gradient has a central frame 2' mounted thereto, whose bottom transverse bar $\mathbf{2}_2$ is installed into the receptacle, which is open at the top, of the arms $\mathbf{3}_{12}$ of brackets $\mathbf{3}_1$, and is attached by a pair of U-shaped bolts $\mathbf{3}_2$ to the cross pieces $\mathbf{3}_{13}$ that are rigidly attached to the bracket. The U-bolt $\mathbf{3}_2$ reach around the tube $\mathbf{2}_2$ and are screwed, bolted, or the like, to the cross piece $\mathbf{3}_{13}$ to form a swivel joint. The bracket $\mathbf{3}_1$ is mounted to the foundation 5 by screws, bolts, threaded rods, welds or the like.

FIGS. 6*a–b* show an embodiment of one of the several floating bearings 4. Each floating bearing 4 also has a one-piece bracket $\mathbf{4}_1$ comprising a third channel $\mathbf{4}_{11}$ in which parallel arms $\mathbf{4}_{12}$ are held internally on both sides. Receptacles, which are open at the top for receiving a cross tube $\mathbf{4}_{13}$, are attached at both arms $\mathbf{4}_{12}$. Channel $\mathbf{4}_{11}$, arms $\mathbf{4}_{12}$ and cross tube $\mathbf{4}_{13}$ are arranged symmetrically and mounted together into a one-piece bracket $\mathbf{4}_1$ by welds, nuts, bolts or the like. The length of the cross tube $\mathbf{4}_{13}$ corresponds to the track gauge S.

The bracket $\mathbf{4}_1$ of the floating bearing 4 is mounted to the respective foundation 5 by welds, nuts, bolts, threaded rods or the like. On both sides of the cross tube $\mathbf{4}_{13}$, angle brackets $\mathbf{4}_3$ engage with the bottom legs $\mathbf{2}_{11}$ of the channels $\mathbf{2}_1$ of the frames 2' or 2", which in turn are screwed together with U-shaped bolts $\mathbf{4}_2$ and held at the cross tube $\mathbf{4}_{13}$ of the bracket $\mathbf{4}_1$.

In the screwed together state, the bottom leg $\mathbf{2}_{11}$ of the channels $4_1$ rest against the cross tube $4_{13}$ of the bracket $4_1$, so that the cross tube $4_{13}$ engages with the step Δh formed between the rails 1 and the second channels $2_1$ (see, for example, FIG. 3), and braces the rails 1 in the lateral direction. The angle brackets $4_3$ cooperate with the bottom legs $2_{11}$ of the channels to form a thrust joint, thus allowing some longitudinal displacement, caused by thermal expansion, stress or the like. Further, the bolts $4_2$ rotatably mount the angle brackets $4_3$ *to the* cross tube $4_{13}$.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A rail assembly for guiding a carriage of a stationary inclined elevator, comprising:

a pair of first rails, each having two first legs and a first web integrally coupling said two first legs to each other, each said first web having a plurality of holes therein;

a plurality of frames for coupling said first rails together, each of said frames comprising two second rails each having two second legs, a second web integrally coupling said two second legs to each other, and at least two transverse bars for coupling said second webs to each other, each of said second webs having holes therein and abutting against one said first webs when said frame couples said first rails to each other;

a plurality of foundations; and a plurality of supports for attaching said frames to said foundations, each of said supports being mounted to one of said foundations.

2. A rail assembly as claimed in claim 1, wherein one of said supports is a fixed bearing for rotatably mounting one of said frames to one of said foundations, and at least one of said supports is a floating bearing for slidably rotatably mounting one of said frames to one of said foundations.

3. A rail assembly as claimed in claim 1, wherein said frames are screwed to said first rails.

4. A rail assembly as claimed in claim 1, further comprising a second pair of first rails, one of said frames coupling said first and second pair of first rails together.

5. A rail assembly as claimed in claim 1, wherein said transverse bars are tubes.

6. A rail assembly as claimed in claim 1, wherein said second webs of some of said second rails have three of said holes therein, spaced equidistantly in a longitudinal direction of said second rails.

7. A rail assembly as claimed in claim 1, wherein said second webs of some of said second rails have four of said holes therein spaced in a longitudinal direction of said second rails.

8. A rail assembly as claimed in claim 7, wherein said some of said second rails have longitudinal end projections, two of said holes closest to said longitudinal center of said some of said second rails being spaced from each other at a distance substantially equal to twice the length of a said longitudinal end projection.

9. A rail assembly as claimed in claim 5, wherein said supports each engage at least one of said tubes.

10. A rail assembly as claimed in claim 1, wherein each said floating bearing comprises a cross tube and two angle brackets, rotatably attached to said cross tube, each of said two angle brackets slidably engaging one said leg of each of said second rails.

11. A rail assembly as claimed in claim 1, wherein a height of each of said second rails is smaller by a predetermined dimension than a height of each of said first rails, said first and second rails forming steps therebetween when said frames couple said first rails together.

12. A rail assembly as claimed in claim 11, wherein some of said supports engage said frames at said steps.

13. A rail assembly as claimed in claim 1, wherein said second webs of some of said second rails have a plurality of said holes equidistantly spaced longitudinally in two substantially parallel rows.

14. A rail assembly as claimed in claim 1, wherein in each of said frames, said two second legs of one of said second rails face said two second legs of the other of said second rails, and when said frames couple said first rails together, said two first legs of one of said first rails face away from said two first legs of the other of said first rails.

* * * * *